United States Patent [19]

Strandly

[11] 4,286,631

[45] Sep. 1, 1981

[54] METHOD OF PROVIDING A SEAM IN DOUBLE-LAYER FORMING FABRICS

[76] Inventor: Ingvald Strandly, Brettevillesgate 15, Oslo 4, Norway

[21] Appl. No.: 87,695

[22] Filed: Oct. 23, 1979

Related U.S. Application Data

[63] Continuation-in-part of Ser. No. 943,118, Sep. 8, 1978, Pat. No. 4,206,787.

[30] Foreign Application Priority Data

Jul. 5, 1977 [SE] Sweden ..... 7707787

[51] Int. Cl.[3] ..... D03D 15/00

[52] U.S. Cl. ..... 139/383 A

[58] Field of Search ..... 139/383 A, 425 A; 428/223; 245/10

[56] References Cited

U.S. PATENT DOCUMENTS

| | | | |
|---|---|---|---|
| 4,026,331 | 5/1977 | Lees et al. | 139/383 A |
| 4,095,622 | 6/1978 | MacBean | 139/383 A |
| 4,123,022 | 10/1978 | Dutt et al. | 245/10 |
| 4,206,787 | 6/1980 | Strandly | 139/383 A |

*Primary Examiner*—Henry Jaudon

*Attorney, Agent, or Firm*—Kane, Dalsimer, Kane, Sullivan and Kurucz

[57] ABSTRACT

The present invention is directed to a method of providing a row of loops at each end of a forming fabric, filter cloth or similar weave of a kind comprising two layers of weft threads with the threads positioned in pairs substantially one on top of the other, and warp threads interconnecting the weft layers, said rows of loops intended to be interconnected by a locking wire to form an endless fabric web.

3 Claims, 6 Drawing Figures

METHOD OF PROVIDING A SEAM IN DOUBLE-LAYER FORMING FABRICS

CROSS REFERENCE TO RELATED APPLICATION

This application is a continuation-in-part of Ser. No. 943,118, filed Sept. 18, 1978, now U.S. Pat. No. 4,206,787.

BACKGROUND OF THE INVENTION

Most forming fabrics within the paper, cellulose and asbestos-cement industries must be woven endless. As a rule, the fabrics are made in endless form during the very weaving while using the so-called tubular weaving technique, or else the fabric ends are interconnected during the manufacture, e.g. by splicing. Usually, the splicing can be effected only by the manufacturer during the manufacture of the fabric. On account of the machine construction, some forming fabrics may be end joined only in connection with their mounting in the machine, and in such cases the fabrics must be provided with some suitable joint or seam fastener. Fabric end joining in immediate connection with the installation in the machine is most commonly used in the case of dryer felts and dryer cloths. In these types of products so called belt fasteners are used. The loops of these fasteners are of metal and usually U-shaped. They are attached either on the cloth itself or on separate fastener strips which are sewn onto the cloth ends.

In addition to the dryer section there are, however, several other positions in which it is necessary to deliver an open cloth the ends of which are to be interconnected directly in the machine. For instance, in Inverform machines the cloth does not as a rule lend itself to endless mounting. As belt fasteners are unsuitable for use to join together forming fabrics and certain filter types, a number of alternative possibilities have been developed during recent years to replace the belt fasteners. The one that has found most practical use is the so called loop seam wherein the warp thread ends are removed and thereafter are re-introduced into the weave, after having been formed into locking loops at the cloth end. The locking loops at both ends are then interconnected during the cloth mounting by means of one or several fastening wires. A seam of this kind, performed in a single-layer structure, is described for instance in the Swedish Published Specification No. 322 980.

In forming fabrics, it is important that the seam area has approximately the same openness as the rest of the fabric in order to avoid too pronounced marking and to reduce the risk of web breaks. It is likewise important that the locking loops are designed so as to avoid that they themselves or the warp threads in connection therewith are exposed to more wear than the rest of the fabric.

In later years, double-layer forming fabrics comprising two layers of weft threads and warp threads interconnecting these layers have found increasingly wide applications. Examples of fabrics of this kind are described in the two Swedish Published Specifications Nos. 366 353 and 385 486. Attempts have been made earlier to provide also the type of fabrics defined in these publications with loop seams, thereby making them useful in positions where the fabrics must be joined directly in the machine. On account primarily of their non-symmetric pattern, double-layer fabrics lack the natural properties that would make them suitable for provision of loop seams thereon. The reason therefor is that when the warp threads have formed a loop and are to be re-introduced into the cloth, the re-introduction must be performed in a manner ensuring that the crimp of the thread conforms with the pattern of the cloth. In the past, many loops therefore were either too small, thus making it impossible to pass a locking wire through them, or else too large, whereby openings formed between the locking wire and the rest of the fabric, causing increased marking and also risks of web breaks. Another disadvantage is that the warp thread in connection with the loop formation is exposed on the wear side of the fabric, resulting in increased wear.

SUMMARY OF THE INVENTION

The present invention relates to a method of providing a row of loops at each end of a forming fabric, filter cloth or similar weave of a kind comprising two layers of weft threads with the threads positioned in pairs substantially one on top of the other, and warp threads interconnecting the weft layers, said rows of loops intended to be interconnected by a locking wire to form an endless fabric web.

A method of the invention is characterised in removing permanently the weft threads in a first zone closest to one end edge of said weave, removing temporarily the weft threads in a second zone adjacent said first zone, arranging said temporarily removed weft threads, alternatively a corresponding number of weft threads, together with one coarse folding wire and also one or several thin folding wires as a warp in a sewing machine similar to a loom, of a kind known per se, wherein said coarse wire temporarily replaces said locking wire intended finally to interconnect the two weave ends, where two warp thread ends in succession in accordance with the pattern repeat weave between the threads of the outermost one of said pairs in said second zone of weft threads, carrying one of said warp thread ends, after having woven said warp thread end into said second zone of weft threads in accordance with the correct weaving pattern, in a loop around said thin folding wire (or wires) as well as around said coarse folding wire and thereafter carrying said warp thread end in the reverse direction in the position of said second warp thread to a pick-up point in said second zone of weft threads, at which point said two warp threads meet, where at least two of three consecutive warp thread ends according to the pattern repeat weave between the threads of the outermost pair of said second zone of weft threads, one of these warp thread ends after having been woven according to the pattern into said second zone of weft threads is carried in a loop about the thin folding wire (or wires) as well as the coarse folding wire and then back in the place of one of the other warp threads to a pick-up point in the said second zone of weft threads, at which point the two warp threads meet each other whereas the third warp thread after having been woven according to the pattern into said second zone of weft threads is carried to a pick-up point in connection with the outermost pair of weft threads of said second zone of weft threads, where two subsequent warp thread ends in accordance with the pattern repeat weave over and below, alternatively below, the threads of the outermost one of said pairs in said second zone of weft threads, carrying one of said warp thread ends, after having woven said warp thread end into said second zone of weft threads in accordance with the correct weaving pattern, around said outermost pair of weft threads and the thin folding wire or wires and thereafter carrying said warp thread end in the reverse direction in the position of said second warp thread to a pick-up point in said second zone of weft threads, at which point said two warp threads meet, where at least two of three succeeding warp thread ends according to the pattern repeat weave over and below, alternatively below, the threads of the outermost pair of said second zone of weft threads, one of these weft threads, after having been woven into said second zone of weft threads in correct pattern, weaves about said outermost pair and possibly the thin folding wire (or wires) and then back in the place of one of the other warp threads to a pick-up point in said second zone of weft threads, at which point the two warp threads meet, whereas the third warp thread end after having been woven into said second zone of weft threads in correct pattern is carried to a pick-up point in connection with the outermost pair of weft threads, where one warp thread end in accordance with the pattern repeat weaves between, alternatively above or below, the threads of the outermost one of said pairs in said second zone of weft threads without being followed by a warp thread end having the same alternative weaving pattern, carrying said warp thread end, after having woven said warp thread end in accordance with the correct weaving pattern into said second zone of weft threads, around said outermost pair of weft threads and said thin folding wire or wires to a pick-up point adjacent to said outermost pair of weft threads, and treating said warp thread ends at both edges of said weave in the same manner and preferably simultaneously, said coarse folding wire being common to said warp thread ends of both fabric end edges.

All loops included in the loop rows that are intended to be joined together by a locking wire are formed when warp threads in accordance with the pattern repeat weave between the weft threads of the outermost pair preceding the seam loop itself. In this manner, the warp thread in connection with the seam loop is well protected against wear. Owing to this arrangement, also the seam loop itself will have less thickness than the rest of the fabric, which also spares the seam loop itself from wear. Because one or several threads, which may be thin, at need are inserted only in one layer (single layer) between the double-layer fabric and the coarse folding wire, the openness is decreased in this part of the seam, whereby heavy marking is reduced and there are less risks of web breaks. At the same time, these extra threads do not cause an enlargement of the loops as they are inserted in a single layer half-way between the weft threads of the two layers.

BRIEF DESCRIPTION OF THE DRAWINGS

The invention will be described in closer detail in the following with reference to the accomapnying diagrammatical drawings, wherein the invention is imagined applied in a double-layer forming fabric of a seven-shaft design wherein each warp thread in sequence binds above a pair of weft threads, between a second pair, beneath a third pair, between a fourth pair and a fifth pair, above a sixth pair and between a seventh pair before the procedure is repeated.

In the drawings.

DETAILED DESCRIPTION OF A PREFERRED EMBODIMENT

Figure 1:
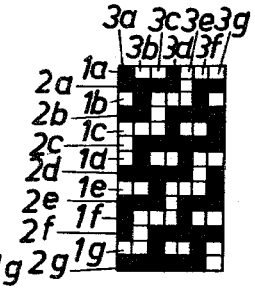
FIG. 1 shows the pattern design of the intended fabric.

In the pattern design illustrated in FIG. 1, the horizontal rows 1 and 2 illustrate the weft threads of the weave and the vertical rows 3 the warp threads of the weave. Cross yarns 1 from the upper layer of weft threads and cross yarns 2 the lower layer. Blackened squares indicate that the warp thread crosses the respective weft thread on the upper face. Accordingly, warp thread 3*a* binds -above the first pair of weft threads 1*a* and 2*a*
-between the second pair of weft threads 1*b* and 2*b*
-beneath the third pair of weft threads 1*c* and 2*c*
-between the fourth pair of weft threads 1*d* and 2*d*
-between the fifth pair of weft threads 1*e* and 2*e*
-above the sixth pair of weft threads 1*f* and 2*f*
-between the seventh pair of weft threads 1*g* and 2*g*, before the procedure is repeated.

Figure 2A:
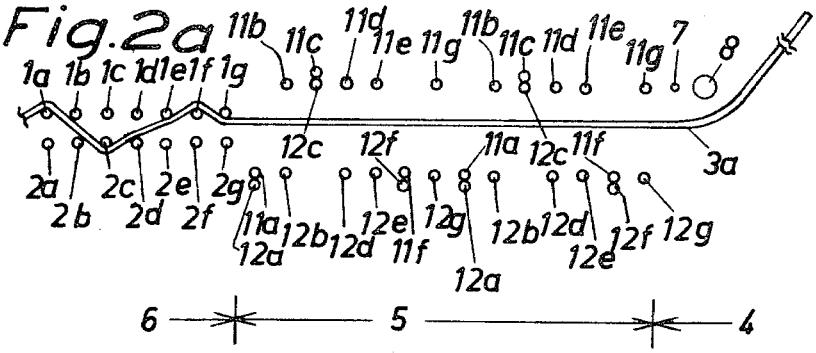
FIGS. 2*a*, 2*b*, 2*c* and 2*d* show for different stages of producing a seam loop.
Figure 2B:
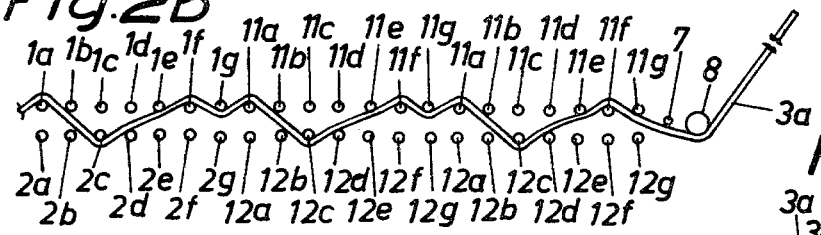
Figure 2C:
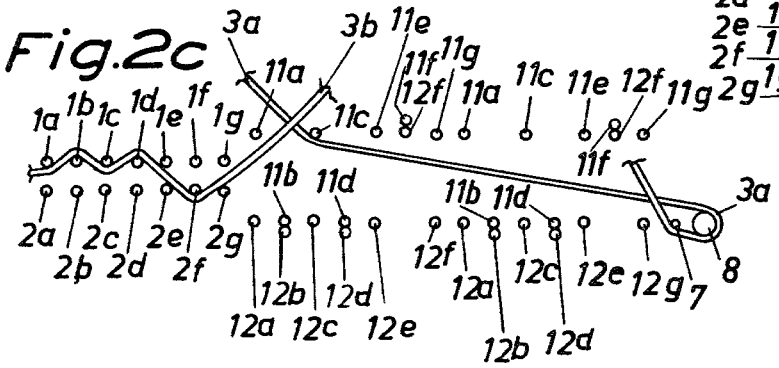
Figure 2D:
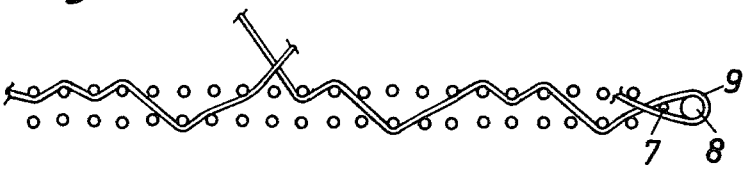

FIG. 2*a* shows warp thread 3*a*, permanently freed of weft threads in a first zone 4 at the right-hand part of the Figure. In the adjacent second zone 5, the weft threads have been temporarily removed, and a corresponding number of threads have thereafter been inserted to serve as the warp in a known sewing machine (not shown) which is similar to a loom. At the far left, wire section 6 is shown as positioned laterally of the very seam area. In the sewing machine is additionally applied a thin extra folding wire 7 as well as a coarser folding wire 8. In FIG. 2*a*, the shed of the first warp thread 3*a* is formed in such a manner that weft threads 11*b*, 11*c*, 12*c*, 11*d*, 11*e*, 11*g* and folding wires 7 and 8 form the upper shed whereas weft threads 11*a*, 12*a*, 12*b*, 12*d*, 11*f*, 12*f*, and 12*g* form the lower shed. After introduction of warp thread 3*a*, the shed is closed in the manner indicated in FIG. 2*b*. In FIG. 2*c*, the following shed is shown, formed in a manner identical with the shed associated with warp thread 3*b* in accordance with FIG. 1. Warp thread 3*a* is folded about folding wires 7 and 8 and is reintroduced over a portion of zone 5 to a pick-up location between threads 11*a* and 11*c*. The warp thread 3*b* is inserted in the shed up to the same pick-up location. In FIG. 2*d*, the shed is again in closed position. Warp thread 3*a* has formed the seam loop about folding wires 7 and 8.

In a preferred embodiment the weft threads 11*g* and 12*g* have been chosen as the outermost pair in the second zone 5 of weft threads. This outermost pair of weft threads appears also in the pattern repeat design illustrated in FIG. 1 as the two lowermost weft threads 1*g* and 2*g*. Accordingly, warp threads 3*a*–3*g* bind with this outermost pair of weft threads in the following sequence:

warp thread 3*a* between said pair of weft threads (black and white squares respectively)
warp thread 3*b* between said pair of weft threads
warp thread 3*c* above said pair of weft threads (two black squares)
warp thread 3*d* between said pair of weft threads
warp thread 3*e* between said pair of weft threads
warp thread 3*f* above said pair of weft threads warp thread 3g beneath said pair of weft threads (two white squares)

Figure 3:
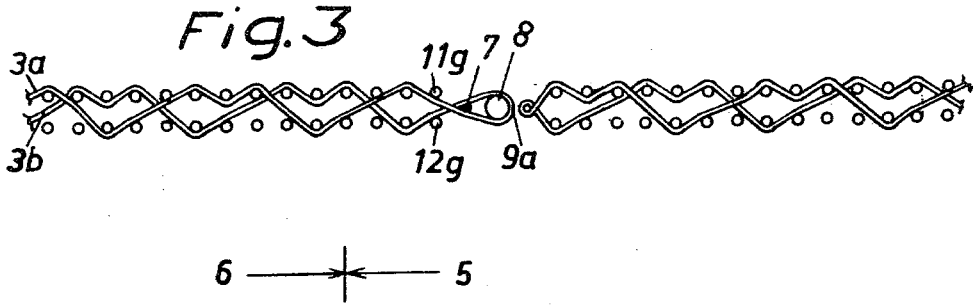
FIGS. 3 to 6 illustrate the method in connection with all threads of the applied pattern of the fabric.

The ends of the two first warp threads 3a and 3b in succession weave between the outermost pair of weft threads 11g and 12. In the left-hand section of FIG. 3, warp thread 3a is inserted in its regular position up to and between the outermost pair of weft threads 11g and 12g in the way described with reference to FIGS. 2a and 2b. After having been folded in a loop around threads 7 and 8 the warp thread is inserted in its re-introduced position, replacing warp thread 3b in the way described with reference to FIGS. 2c and 2d.

Figure 4:
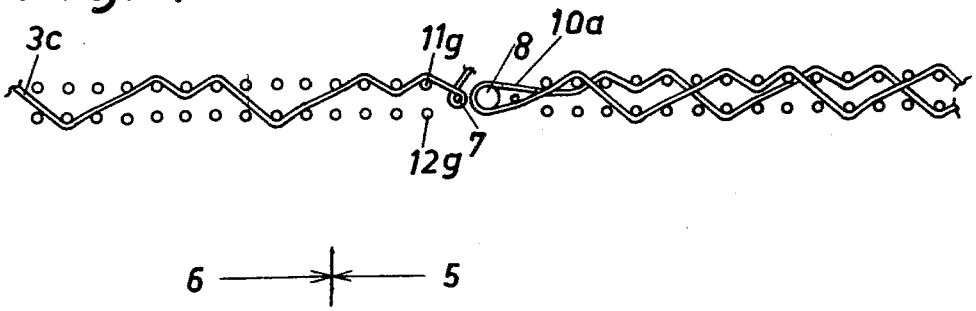

Warp thread 3c weaves above the weft threads 11g and 12g of the outermost pair of zone 5 but is followed by a warp thread 3d which weaves between said pair of weft threads. For this reason, the warp thread 3c cannot form a seam loop. In the left hand section of FIG. 4 warp thread 3c is inserted in its regular position up to and above the outermost pair of weft threads 11g and 12g. Then the warp thread 3c is carried around the thin folding thread 7 to a pick-up location between said folding thread and the outermost pair of weft threads 11g and 12g.

Figure 5:
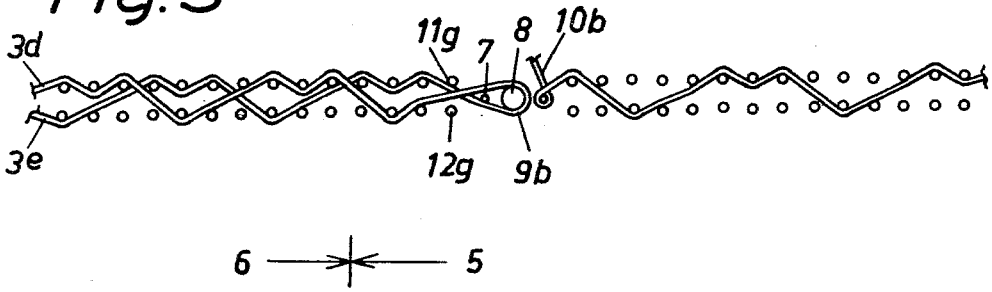

Warp threads 3d and 3e both weave between weft threads 11g and 12g of the outermost pair in zone 5. In the left-hand part of the section in FIG. 5 the warp thread is inserted in its regular position through zone 5 up to and between the outermost pair of weft threads 11g and 12g. Thereafter the warp thread 3d is carried in a loop around the thin folding thread 7 as well as the coarse folding wire 8 and back into zone 5 in the position of and replacing warp thread 3e up to an appropriate pick-up location (not shown), where the warp thread 3d meets warp thread 3e. The loop 9b thus formed, like loop 9a formed by warp thread 3a, serves as seam loops for a final joining-together of the fabric ends.

Figure 6:
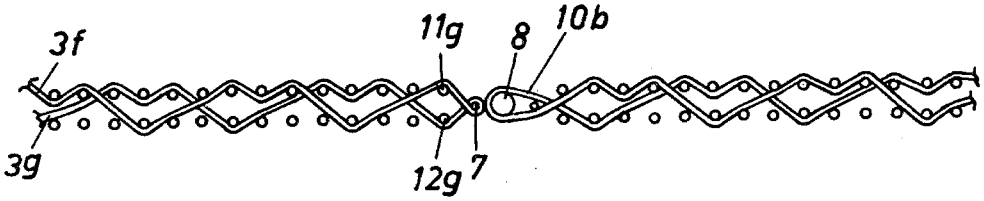

Warp thread 3f and 3g weave respectively above and beneath the weft threads 11g and 12g of the outermost pair in zone 5. As illustrated in the left-hand part of the section in FIG. 6 the warp thread 3f is first inserted in its regular position through zone 5 up to and above the outermost pair of weft threads 11g and 12g. Thereafter, the warp thread 3f is carried around the thin folding thread 7 back into zone 5 in the position of and replacing the warp thread 3g up to an appropriate pick-up location (not shown), where warp thread 3f meets warp thread 3g. In this case no seam loop is formed around the folding wire 8.

At the opposite fabric end (right-hand section of FIGS. 3 to 6), one proceeds in the same manner, as indicated above, the two seam loops 10 a (FIG. 4) and 10b (FIG. 6) thus being formed. Before mounting the fabric on a paper machine, the fabric is opened up by removal of folding wire 8, and after mounting, the seam loops 9 and 10 are again placed in interdigited position and one or several locking wires are passed through the loops.

In a seam produced in this manner the warp threads in connection with the seam loops as well as the seam loops themselves are in positions wherein they are well protected against wear. The additional folding wires which are retained in position by the warp threads that do not form seam loops, may be adjusted to ensure the correct size of the seam loops, in addition to which the openness is reduced to avoid pronounced marking and risks that web breaks may occur.

The invention is applicable to most double-layer fabrics of various patterns and is especially suitable for fabrics having non-symmetric patterns wherein the warp thread weaves differently in the two weft yarn layers.

In the illustrated embodiment the weaving pattern according to FIG. 1 is formed so that the warp threads 3a, 3d and 3f after having been folded may be reinserted in the place of the warp thread 3b, 3e and 3g, respectively. When other weaving patterns are used, it may be better to form the loop by reinserting the warp thread after having been folded not in the place of adjacent warp thread but in the place of the succeeding warp thread if this gives a more correct weaving pattern.

Such an embodiment requires that at least a first and a third warp thread lying adjacent a second warp thread of the same alternative binding, i.e. at least two of three consecutive warp thread ends according to the weaving repeat bind between alternatively above or below the threads at the outermost pair of weft threads of zone 5. The warp thread lying between is thereby carried to a pick-up point in connection to the said outermost pair of weft threads.

What is claimed is:

1. A method of providing a row of loops at each end of a weave, said weave comprising two layers of weft threads with the threads positioned in pairs substantially one above the other, warp threads interconnecting said weft layers, and a locking wire intended to interconnect said rows of loops to form an endless fabric web, the method comprising:

removing permanently the weft threads in a first zone closest to one end edge of said weave;

removing temporarily the weft threads in a second zone adjacent said first zone;

arranging said temporarily removed weft threads, alternatively a corresponding number of weft threads, together with one coarse folding wire and also one or several thin folding wires as a warp wherein said coarse wire temporarily replaces said locking wire intended finally to interconnect the two weave ends, where two warp thread ends in succession in accordance with the pattern repeat weave between the threads of the outermost one of said pairs in said second zone of weft threads, carrying one of said warp thread ends, after having woven said warp thread end into said second zone of weft threads in accordance with the correct weaving pattern, in a loop around said thin folding wire (or wires) as well as around said coarse folding wire and thereafter carrying said warp thread end in the reverse direction in the position of said second warp thread to a pick-up point in said second zone of weft threads, at which point said two warp threads meet, where at least two of three consecutive warp thread ends according to the pattern repeat weave between the threads of the outermost pair of said second zone of weft threads, one of these warp thread ends after having been woven according to the pattern into said second zone of weft threads is carried in a loop about the thin folding wire (or wires) as well as the coarse folding wire and then back in the place of one of the other warp threads to a pick-up point in the said second zone of weft threads, at which point the two warp threads meet each other whereas the third warp thread after having been woven according to the pattern into said second zone of weft threads is carried to a pick-up point in connection with the outermost pair of weft threads of said second zone of weft threads;

where two subsequent warp thread ends in accordance with the pattern repeat weave over and below, alternatively below, the threads of the outermost one of said pairs in said second zone of weft threads, carrying one of said warp thread ends, after having woven said warp thread end into said second zone of weft threads in accordance with the correct weaving pattern, around said outermost pair of weft threads and the thin folding wire or wires and thereafter carrying said warp thread end in the reverse direction in the position of said second warp thread to a pick-up point in said second zone of weft threads, at which place said two warp threads meet;

where at least two of three succeeding warp thread ends according to the pattern repeat weave over and below, alternatively below, the threads of the outermost pair of said second zone of weft threads, one of these weft threads, after having been woven into said second zone of weft threads in correct pattern, weaves about said outermost pair and the thin folding wire (or wires) and then back in the place of one of the other warp threads to a pick-up point in said second zone of weft threads, at which point the two warp threads meet, whereas the third warp thread end after having been woven into said second zone of weft threads in correct pattern is carried to a pick-up point in connection with the outermost pair of weft threads, where one warp thread end in accordance with the pattern repeat weaves between, alternatively above or below, the threads of the outermost one of said pairs in said second zone of weft threads without being followed by a warp thread end having the same alternative weaving pattern, carrying said warp thread end, after having woven said warp thread end in accordance with the correct weaving pattern into said second zone of weft threads, around said outermost pair of weft threads and said thin folding wire or wires to a pick-up point adjacent to said outermost pair of weft threads, and treating said warp thread ends at both edges of said weave in the same manner and preferably simultaneously, said coarse folding wire being common to said warp thread ends of both fabric end edges.

2. The method as claimed in claim 1, comprising forming said row of loops intended to be interconnected such that every one of said warp threads crosses one of the weft threads of said layers of weft threads a larger number of times than it crosses the weft threads of the other one of said layers.

3. The method as claimd in claim 1 wherein said weave is a forming fabric.

* * * * *